US008011894B2

(12) United States Patent
Arness et al.

(10) Patent No.: US 8,011,894 B2
(45) Date of Patent: Sep. 6, 2011

(54) SEALING MECHANISM WITH PIVOT PLATE AND ROPE SEAL

(75) Inventors: Brian P. Arness, Simpsonville, SC (US); Louis Veltre, Simpsonville, SC (US); Ariel Kelsey Coleman Harter, Simpsonville, SC (US); John D. Wardell, Woodruff, SC (US)

(73) Assignee: General Electric Company, Schenectady, NY (US)

( * ) Notice: Subject to any disclaimer, the term of this patent is extended or adjusted under 35 U.S.C. 154(b) by 686 days.

(21) Appl. No.: 12/168,929

(22) Filed: Jul. 8, 2008

(65) Prior Publication Data

US 2010/0008769 A1 Jan. 14, 2010

(51) Int. Cl.
*F01D 5/30* (2006.01)

(52) U.S. Cl. ..... 416/219 R; 416/220 R

(58) Field of Classification Search ..... 416/219 R, 416/220 R, 221, 239, 248
See application file for complete search history.

(56) References Cited

U.S. PATENT DOCUMENTS

| | | | | |
|---|---|---|---|---|
| 3,023,998 | A * | 3/1962 | Sanderson, Jr. | 415/173.7 |
| 3,709,631 | A | 1/1973 | Karstensen et al. | |
| 4,422,827 | A | 12/1983 | Buxe et al. | |
| 4,480,957 | A | 11/1984 | Patel et al. | |
| 4,494,909 | A | 1/1985 | Forestier | |
| 4,725,200 | A | 2/1988 | Welhoelter | |
| 4,743,164 | A | 5/1988 | Kalogeros | |
| 4,743,166 | A | 5/1988 | Elston, III et al. | |
| 5,052,890 | A | 10/1991 | Roberts | |
| 5,052,893 | A | 10/1991 | Catte | |
| 5,139,389 | A | 8/1992 | Eng et al. | |
| 5,256,035 | A * | 10/1993 | Norris et al. | 416/220 R |
| 5,257,909 | A | 11/1993 | Glynn et al. | |
| 5,599,170 | A | 2/1997 | Marchi et al. | |
| 5,823,743 | A | 10/1998 | Faulkner | |
| 6,273,683 | B1 | 8/2001 | Zagar et al. | |
| 6,296,172 | B1 | 10/2001 | Miller | |
| 6,375,429 | B1 | 4/2002 | Halila et al. | |
| 6,565,322 | B1 | 5/2003 | Lieser et al. | |
| 6,575,704 | B1 | 6/2003 | Tiemann | |
| 6,682,307 | B1 * | 1/2004 | Tiemann | 416/193 A |

FOREIGN PATENT DOCUMENTS

| | | | |
|---|---|---|---|
| EP | 0774048 | A1 | 5/1997 |
| WO | 9412772 | A1 | 6/1994 |

* cited by examiner

*Primary Examiner* — Matthew W Such
*Assistant Examiner* — Ali Naraghi
(74) *Attorney, Agent, or Firm* — Sutherland Asbill & Brennan LLP

(57) ABSTRACT

A sealing system for sealing a gap between a dovetail tab of a bucket and a rotor. The sealing system may include a sealing slot positioned about the dovetail tab and a pivot plate positioned within the sealing slot. The sealing slot may include a pivot point and a rest ledge such that the pivot plate pivots about the pivot point and into the gap when the bucket rotates.

12 Claims, 4 Drawing Sheets

SEALING MECHANISM WITH PIVOT PLATE AND ROPE SEAL

TECHNICAL FIELD

The present application relates generally to any type of turbine and more particularly relates to systems and methods for sealing a gap formed between a turbine bucket dovetail and a turbine rotor via a pivot plate and a rope seal.

BACKGROUND OF THE INVENTION

Gas turbines generally include a turbine rotor (wheel) with a number of circumferentially spaced buckets (blades). The buckets generally may include an airfoil, a platform, a shank, a dovetail, and other elements. The dovetail of each bucket is positioned within the turbine rotor and secured therein. The airfoils project into the hot gas path so as to convert the kinetic energy of the gas into rotational mechanical energy. A number of cooling medium passages may extend radially through the bucket to direct an inward and/or an outward flow of the cooling medium therethrough.

Leaks may develop in the coolant supply circuit based upon a gap between the tabs of the dovetails and the surface of the rotor due to increases in thermal and/or centrifugal loads. Air losses from the bucket supply circuit into the wheel space may be significant with respect to blade cooling medium flow requirements. Moreover, the air may be extracted from later compressor stages such that the penalty on energy output and overall efficiency may be significant during engine operation.

Efforts have been made to limit this leak. For example, one method involves depositing aluminum on a dovetail tab so as to fill the gap at least partially. Specifically, a circular ring may be pressed against the forward side of the dovetail face. Although this design seals well and is durable, the design cannot be easily disassembled and replaced in the field. Rather, these rings may only be disassembled when the entire rotor is disassembled.

There is thus a desire for improved dovetail tab sealing systems and methods. Such systems and methods should adequately prevent leakage therethrough so as to increase overall system efficiency while being installable and/or repairable in the field.

SUMMARY OF THE INVENTION

The present application thus provides a sealing system for sealing a gap between a dovetail tab of a bucket and a rotor. The sealing system may include a sealing slot positioned about the dovetail tab and a pivot plate positioned within the sealing slot. The sealing slot may include a pivot point and a rest ledge such that the pivot plate pivots about the pivot point and into the gap when the bucket rotates.

The present application further provides a sealing system for sealing a gap between a dovetail tab of a bucket and a rotor. The sealing system may include a sealing slot positioned about the dovetail tab, a pivot plate positioned within the sealing slot, and a rope seal positioned about the pivot plate. The sealing slot may include a pivot point and a rest ledge such that the pivot plate pivots about the pivot point and into the gap when the bucket rotates.

The present application further provides a method of sealing a gap between a dovetail tab of a bucket and a rotor. The method may include positioning a pivot plate within a sealing slot of the dovetail tab, rotating the bucket, and pivoting the pivot plate into the gap under centrifugal force. The method further may include positioning a seal about the plate and deforming the seal against the sealing slot when the bucket rotates.

These and other features of the present application will become apparent to one of ordinary skill in the art upon review of the following detailed description when taken in conjunction with the several drawings and the appended claims.

DETAILED DESCRIPTION

Figure 1A:
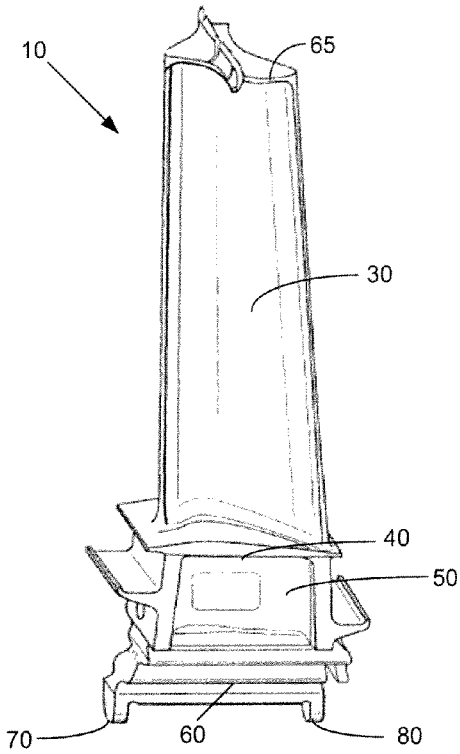
Fig. 1A Prior Art
FIG. 1A is a perspective view of a bucket with a shroud that may be used with the sealing systems as are described herein.
Figure 2:
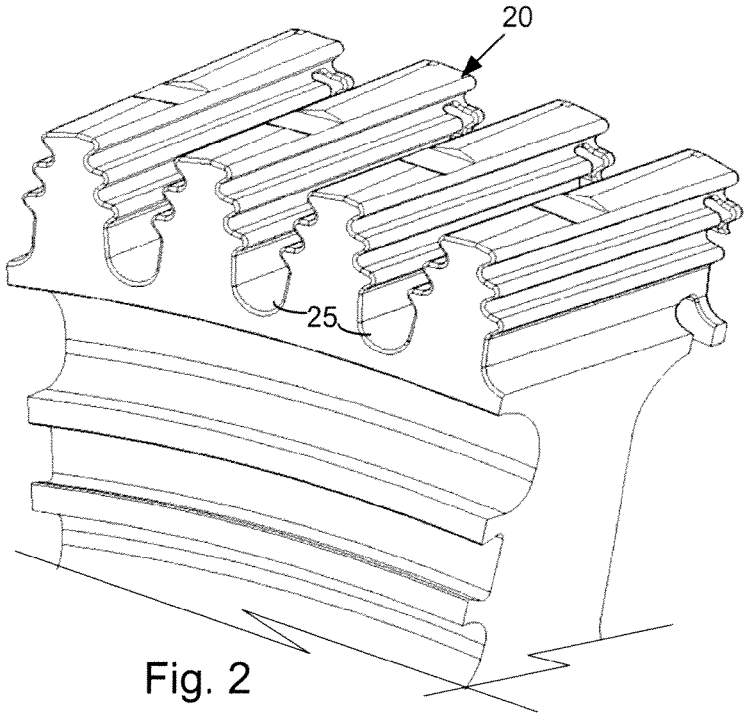
FIG. 2 is a perspective view of a rotor that may be used with the sealing systems as are described herein.
Figure 3A:
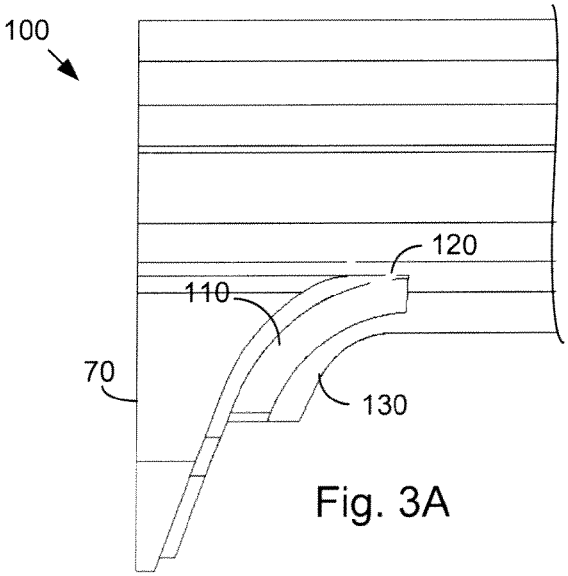
FIG. 3*a* is a side plan view of a dovetail tab that may be used with the sealing systems as are described herein.
Figure 3B:
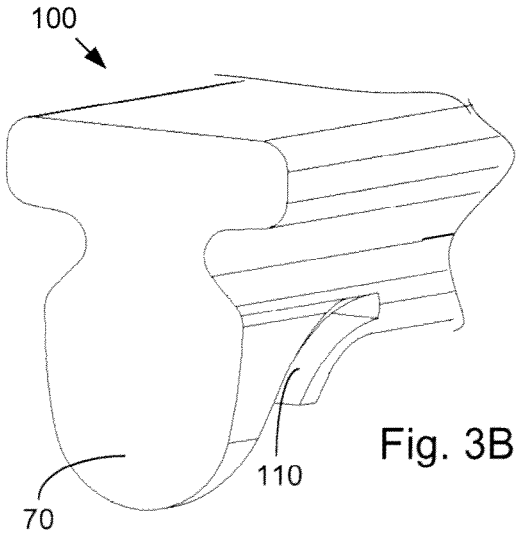
FIG. 3B is a perspective view of a dovetail tab of FIG. 3A.
Figure 4:
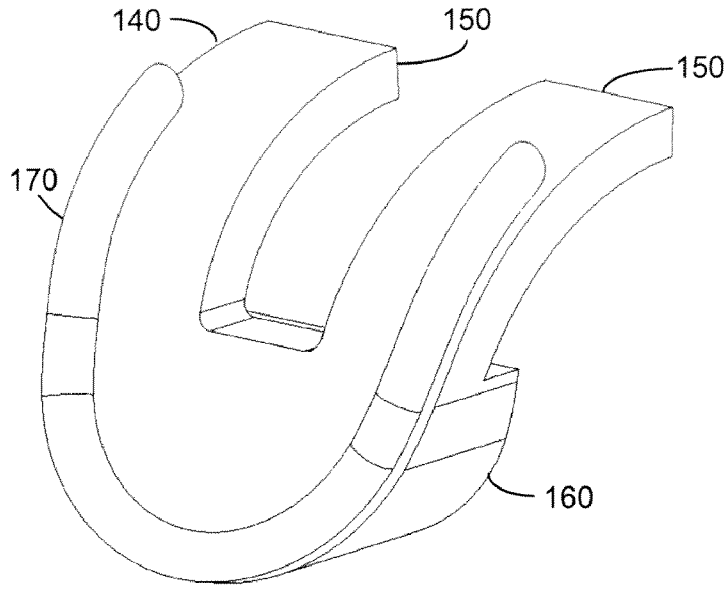
FIG. 4 is a perspective view of a sealing system as is described herein.

Referring now to the drawings, in which like numerals refer to like elements throughout the several views, FIG. 1A shows a bucket 10 as may be used herein. The bucket 10 may be a first or a second stage bucket as used in a 7FA+e gas turbine sold by General Electric Company of Schenectady, N.Y. Any other type of bucket or stage also may be used herein. The bucket 10 may be used with a rotor 20 as is shown in FIG. 2.

Figure 1B:
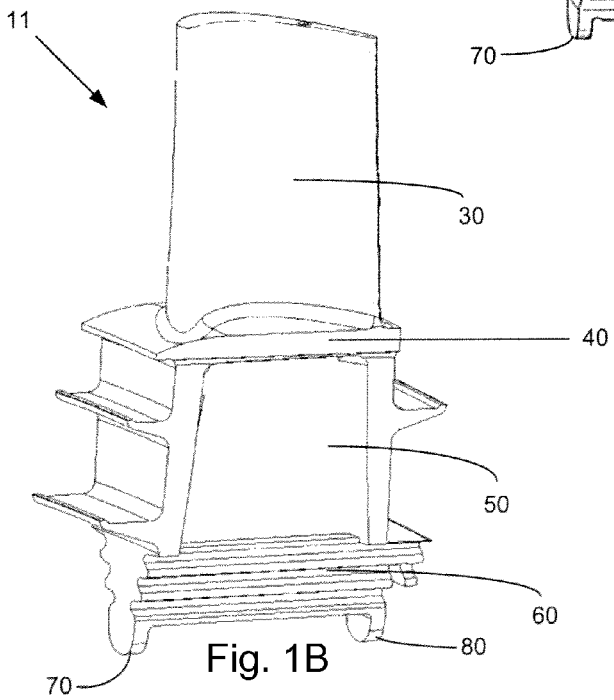
Fig. 1B Prior Art
FIG. 1B is a perspective view of a bucket without a shroud that may be used with the sealing systems as are described herein.

As is known, the bucket 10 may include an airfoil 30, a platform 40, a shank 50, a dovetail 60, and other elements. It will be appreciated that the bucket 10 is one of a number of circumferentially spaced buckets 10 secured to and about the rotor 20 of the turbine. The bucket 10 of FIG. 1A has a shroud 65 on one end of the airfoil 30. A bucket 11 of FIG. 1B lacks the shroud. Any other type of bucket design may be used herein.

As described above, the rotor 20 may have a number of slots 25 for receiving the dovetails 60 of the buckets 10. Likewise, the airfoils 30 of the buckets 10 project into the hot gas stream so as to enable the kinetic energy of the stream to be converted into mechanical energy through the rotation of the rotor 20. The dovetail 60 may include a first tang or tab 70 and a second tab 80 extending therefrom. Similar designs may be used herein. A gap 90 may be formed between the ends of the tabs 70, 80 of the dovetail 60 and the rotor 20. A high pressure cooling flow may escape via the gap 90 unless a sealing system of some type is employed.

FIGS. 3A-6 show a sealing system 100 as is described herein. The sealing system 100 may be positioned about and within the first tab 70 of the dovetail 60 of the bucket 10. The sealing system 100 may include a sealing slot 110 positioned within the first tab 70. The sealing slot 110 may extend about the perimeter of the first tab 70 in whole or in part. The sealing slot 110 may define a pivot point 120 on one side thereof and a rest ledge 130 on the other side thereof. The dimensions and shape of the sealing slot 110 may vary. The sealing slot 110 may be formed with conventional machining techniques.

Other types of manufacturing techniques also may be used herein. The sealing system 100 also may be used with the second tab 80 and elsewhere.

The sealing system 100 also may include a plate 140. The plate 120 may be positioned within the sealing slot 110. The plate 140 may be made out of conventional metals. The plate 140 may have a substantially curved shape so as to largely conform to the shape of the sealing slot 110. Specifically, the plate 140 defines two upper arms 150 that extend between the pivot point 120 and the rest ledge 130. As is described in more detail below, the sealing slot 110 has a certain amount of give between the pivot point 120 and the rest ledge such that the plate 140 can pivot therein. The plate 140 further defines a wedge 160 below the two upper arms 150. The wedge 160 largely conforms to the size and shape of the tab 70.

Positioned about one side of the plate 140 may be a rope seal 170. The rope seal 170 may be made out of graphite, braded metallics, and similar types of substantially deformable, temperature resistant materials. The rope seal 170 may have a largely circular cross-section although other shapes may be used herein. Likewise, a plate seal that extends across the plate 140 in whole or in part and other configurations may be used herein.

Figure 5:
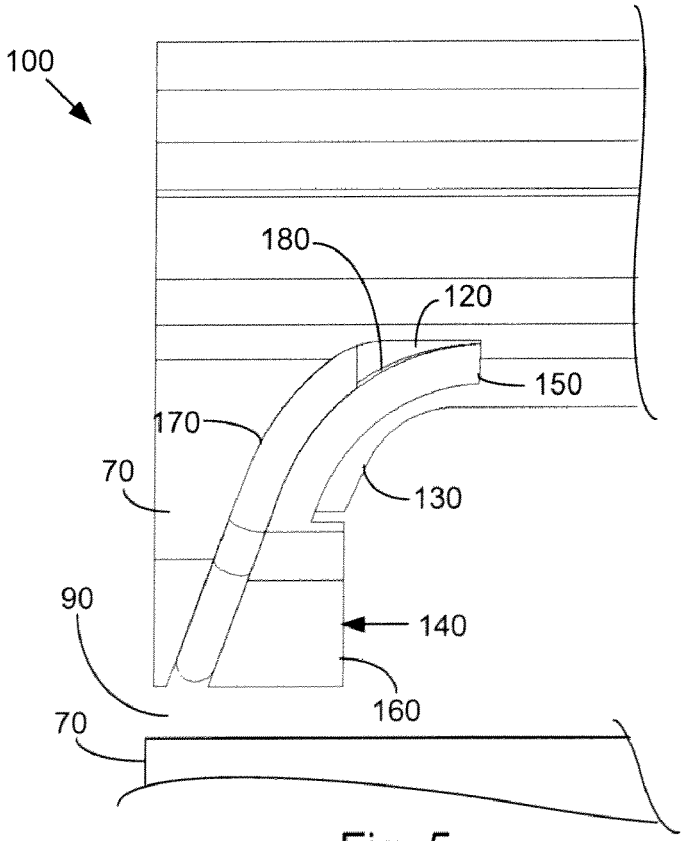
FIG. 5 is a side plan view of the sealing system of FIG. 4 positioned within the dovetail tab and at rest.

As is shown in FIG. 5, when the bucket 10 is at rest, the upper arms 150 of the plate 140 rest on the rest ledge 130 of the tab 70. A slight upper gap 180 extends between the upper arms 150 and the sealing slot 110 near the pivot point. Likewise, the gap 90 extends between the tab 70 and the rotor 20.

Figure 6:
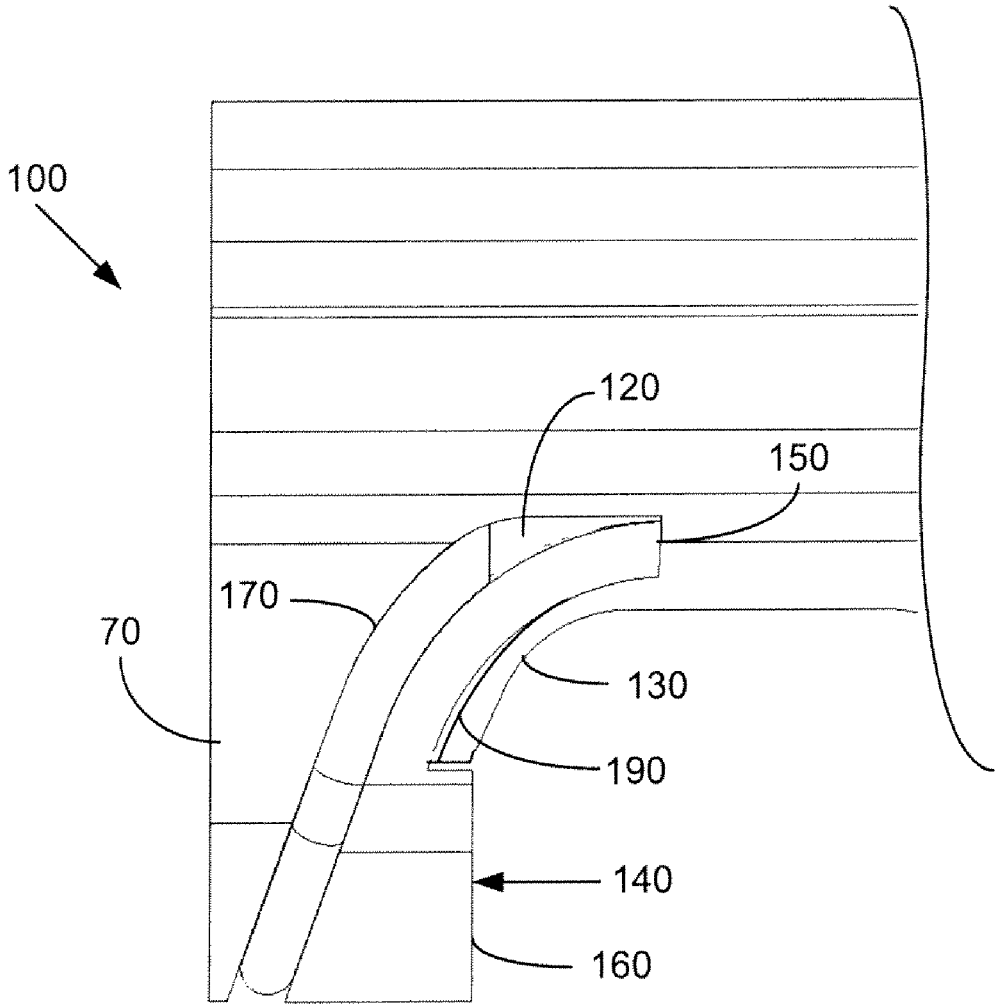
FIG. 6 is a side plan view of the sealing system of FIG. 4 positioned within the dovetail tab and in motion.

As is shown in FIG. 6, rotation of the bucket 10 causes a centrifugal force about the sealing system 100. Specifically, the centrifugal force forces the upper arms 150 of the plate 140 to pivot about the pivot point 120 so as to close the upper gap 180. In doing so, a lower gap 190 is formed between the upper arms 150 of the plate 140 and the rest ledge 130 of the tab 70. Likewise, the plate 140 forces the rope seal 170 against the sealing slot 110. The pivoting also forces the wedge 160 of the plate 140 into the gap 90 so as to close the gap 90 or at least limit the effective area of the gap 90. Such pivoting prevents or reduces leakage from the cooling supply air to the wheel space when the bucket 10 is at full or high speed.

Use of the sealing system 100 thus reduces leakage through the gap 90. Sealing efficiency similar to that of the commonly used aluminum coating thus may be found and improved upon without the use of the aluminum material. The reduction of cooling flow thus improves overall system efficiency. The sealing system 100 may be used with other sealing systems and methods.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A sealing system for sealing a gap between a dovetail tab of a bucket and a rotor, comprising: a sealing slot positioned in the dovetail tab; the sealing slot comprising a pivot point and a rest ledge; and a pivot plate positioned within the sealing slot between the rest ledge, the pivot point, and the dovetail tab; wherein the pivot plate comprises: a front surface and a back surface; two arms with an arm gap therebetween covering the rest ledge; a wedge formed on the back surface of the pivot plate; and a seal on the front surface of the pivot plate and filling a portion of the gap.

2. The sealing system of claim 1, wherein the sealing slot extends about a perimeter of the tab in whole or in part.

3. The sealing system of claim 1, wherein the sealing slot and the pivot plate define an upper gap when the bucket is at rest.

4. The sealing system of claim 1, wherein the sealing slot and the pivot plate define a lower gap when the bucket is in motion.

5. The sealing system of claim 1, wherein the seal comprises a substantially deformable material.

6. The sealing system of claim 1, wherein the seal comprises a rope seal.

7. The sealing system of claim 1, wherein the seal comprises a substantially circular cross-sectional shape.

8. A sealing system for sealing a gap between a dovetail tab of a bucket and a rotor, comprising: a sealing slot positioned in the dovetail tab; the sealing slot comprising a pivot point and a rest ledge; a pivot plate positioned within the sealing slot; the pivot plate comprising a plurality of arms covering the rest ledge on a first side; a wedge on a second side; and a rope seal on the first side of the pivot plate and filling a portion of the gap; wherein the pivot plate pivots about the pivot point and into the gap when the bucket rotates.

9. The sealing system of claim 8, wherein the sealing slot extends about a perimeter of the tab in whole or in part.

10. The sealing system of claim 8, wherein the sealing slot and the pivot plate define an upper gap when the bucket is at rest.

11. The sealing system of claim 8, wherein the sealing slot and the pivot plate define a lower gap when the bucket is in motion.

12. The sealing system of claim 8, wherein the rope seal comprises a substantially deformable material.

* * * * *